United States Patent [19]

Snyder

[11] Patent Number: 4,724,595

[45] **Date of Patent: * Feb. 16, 1988**

[54] BLADDER MANDREL FOR HYDRAULIC EXPANSIONS OF TUBES AND SLEEVES

[75] Inventor: David A. Snyder, N. Huntingdon Township, Allegheny County, Pa.

[73] Assignee: Westinghouse Electric Corp., Pittsburgh, Pa.

[ * ] Notice: The portion of the term of this patent subsequent to Oct. 14, 2003 has been disclaimed.

[21] Appl. No.: 865,482

[22] Filed: May 21, 1986

Related U.S. Application Data

[63] Continuation of Ser. No. 657,553, Oct. 4, 1984, Pat. No. 4,616,392.

[51] Int. Cl.[4] ..... B23P 19/04

[52] U.S. Cl. ..... 29/283.5; 29/727; 269/48.1

[58] Field of Search ..... 279/2 A; 269/48.1, 22; 29/283.5, 727

[56] References Cited

U.S. PATENT DOCUMENTS

| | | | |
|---|---|---|---|
| 3,507,507 | 4/1970 | Tobler et al. | 279/2 A |
| 4,194,284 | 3/1980 | Diels et al. . | |
| 4,368,996 | 1/1983 | Davis et al. | 269/48.1 X |

FOREIGN PATENT DOCUMENTS

| | | | |
|---|---|---|---|
| 0039196 | 11/1981 | European Pat. Off. . | |
| 1109466 | 6/1961 | Fed. Rep. of Germany | 269/48.1 |
| 2074914 | 11/1981 | United Kingdom . | |

*Primary Examiner*—Robert C. Watson

[57] ABSTRACT

A bladder mandrel utilizing a sleeve of Pellethane ® to effect tube expansions is disclosed herein. The sleeve which forms the bladder of the mandrel terminates in sealing beads which include fluid-capturing recesses. When the beads of the sleeve are secured within grooves provided in the mandrel body, pressurized fluid flowing through the fluid port of the mandrel enters the fluid-capturing recesses of the beads and sealingly engages these beads within their respective grooves. The sleeve consequently fills with the pressurized fluid, and effects the desired tube expansion. The walls of the sleeve are thinnest at their center portion, and become progressively thicker toward the sealing beads. The use of a Pellethane ® sleeve having a centrally disposed thin-walled section results in a bladder mandrel having a relatively small outer diameter, which in turn allows it to be inserted within a tube without the need for lubricants. Additionally, the invention inclues a pair of grooved joints for conveniently detaching the sealing beads of the sleeve from the body of the mandrel when replacement of the sleeve is necessary.

24 Claims, 8 Drawing Figures

BLADDER MANDREL FOR HYDRAULIC EXPANSIONS OF TUBES AND SLEEVES

This is a continuation of application Ser. No. 657,553, filed Oct. 4, 1984, now U.S. Pat. No. 4,616,392.

BACKGROUND OF THE INVENTION

1. Field of the Invention

This invention relates to a bladder mandrel which may be used to expand tubes and sleeves in steam generators. The invention is particularly useful in creating interference-type joints between reinforcing sleeves and the heat exchange tubes in nuclear steam generators.

2. Description of the Prior Art

Mandrels for hydraulically expanding the heat exchange tubes in nuclear steam generators are known in the prior art. Such mandrels typically include a mandrel body having an orifice for conducting pressurized water from a hydraulic expansion unit to the outer surface of the mandrel, and a pair of O-rings which flank the orifice on either side. The O-rings circumscribe a pair of opposing, frustro-conical ramps which extend away from the fluid orifice in both directions. When the mandrel is inserted within the tube (or sleeve) to be expanded, the outer edges of the resilient O-rings come into sealing engagement with the inner walls of the tube. When pressurized water is pumped through the fluid orifice, the annular space between the two O-rings which flanks the orifice fills with pressurized water, which in turn rolls each of the O-rings up its respective frustro-conical ramp and wedges it progressively tighter between the body of the mandrel and the inner walls of the tube. Finally, each of the O-rings rolls into a spring-loaded shoulder which circumscribes the distal end of its respective frustro-conical ramp, which arrests the motion of the O-ring. The hydraulic pressure exerted by the water then causes the region of the tube between the O-rings to expand outwardly until it is inelastically deformed about its radius. A more complete description of both the structure and operation of such mandrels is set forth in U.S. patent application Ser. No. 567,107, filed Dec. 30, 1983 and assigned to Westinghouse Electric Corporation, the entire specification of which is expressly incorporated herein by reference.

To fully appreciate the importance of the radial tube and sleeve expansions implemented by such mandrels, some background in the maintenance problems and procedures associated with steam generators is necessary.

Nuclear steam generators generally include a primary side through which hot, radioactive water from the reactor core is admitted into a plurality of U-shaped heat exchange tubes. Such steam generators further include a secondary side which houses and spaces these tubes and circulates a flow of non-radioactive water therethrough, so that non-radioactive steam may be generated from the energy output of the reactor core. The primary and secondary sides of the steam generator are separated by means of a tubesheet having an array of bores, in which both the inlets and outlets of the U-shaped heat exchange tubes are mounted. In the secondary side of the steam generator, the U-shaped tubes are uniformly spaced apart from one another by an array of horizontally disposed support plates, each of which includes a plurality of bores through which the U-shaped tubes extend.

Despite the fact that both the tubesheet and the U-shaped tubes are formed from corrosion-resistant metals such as Inconel, a serious amount of tube corrosion has occurred in many nuclear steam generators in the sections of the U-shaped tubes which are mounted within the bores in the tubesheet, and those sections of the U-shaped tubes which extend through the bores in the support plates. More specifically, corrosive sludges have been found to accumulate in the annular spaces between the U-shaped tubes and the bores in both the tubesheets and the support plates. Additionally, the water currents generated by the inflow of non-radioactive water in the secondary side of the generator sometimes causes the heat exchange tubes in the secondary side to vibrate within the annular space between the outside surface of the tube, and the outside surface of the bores in the support plates through which the tubes extend. These corrosive sludges and mechanical vibrations can degrade the integrity of the tube walls in these regions until the walls of these tubes crack and leak. When this happens, radioactive water from the primary side of the nuclear steam generator contaminates the non-radioactive water flowing through the secondary side of the generator.

Hydraulic expansion mandrels are useful in repairing the sections of the U-shaped tubes which have been degraded by such corrosion. In the tubesheet region of the generator, such a mandrel is slid up to the region of the tube in need of repair, along with a reinforcing sleeve (which is usually a tubular section of Inconel having an outer diameter slightly smaller than the inner diameter of the tube). Once the reinforcing sleeve is properly positioned across the degraded section of the tube in need of repair, the mandrel is actuated. Sleeving mandresl typically include two sets of O-rings, and the pressurized water which accumulates between the two sets of O-rings radially expands the reinforcing sleeve at both its top and bottom portions until it is inelastically deformed into the walls of the heat exchange tube in an interference-type joint. In the sections of the tubes which extend through the bores in the support plates, such mandrels may be used to expand the heat exchange tubes so that essentially all of the annular clearance between the tube and the walls of the bore of the support plate is eliminated, which keeps the tube from rattling within the bore and minimizes the possibility of corrosive sludge accumulating between the tube and the bore.

While such mandrels have been used successfully in many tube repairs in nuclear steam generators, certain problems remain. For example, mandrels utilizing a dual O-ring configuration require the use of lubricants such as glycerine on the inner walls of the tube or sleeve prior to insertion of the mandrel within the tube. If such lubricants are not used, the O-rings will tend to bind between the mandrel body and the inner walls of the heat exchange tube when they are being slid up to the section of the tube in need of repair. Such binding will tend to wear out the elastomeric substance forming the O-rings, which in turn will jeopardize the integrity of the water-tight seal when pressurized water wedges the O-rings between the inner wall of the tube (or sleeve) and their respective frustro-conical ramps on the body of the mandrel. Unfortunately, the use of such lubricants to solve the binding problem not only prolongs the amount of time that a worker must be exposed to radiation present in the primary side of the nuclear steam generator, but also creates problems if one wishes to augment the interference-type joint between the sleeve and the tube with a braze joint. Specifically, the glycerine present along the inside walls of the tube can vaporize just as the brazing alloy begins to set, thereby jeopardizing the integrity of the seal between the hardening brazing alloy and the tube in the sleeve. In addition to the need for lubricants, still another problem associated with such prior art mandrels is the limited amount of diametrical expansion which they can impart on the tube or the sleeve-tube combination. Mandrels employing O-rings typically have a maximum diametrical expansion capability of only 0.045 in., at which point the pressurized water begins to extrude the O-rings between the inner walls of the tube or sleeve and the spring-loaded retaining shoulders located on the ends of the frustro-conical ramps. thereby damaging them. Such O-ring damage will adversely affect the reliability of the mandrel in producing expansions, and will shorten the life of the O-rings, which in turn will necessitate more frequent replacement of these rings.

Clearly, there is a need for a hydraulic expansion mandrel which is capable of being easily inserted into a sleeve or a tube without the need for lubricants, and which has the capability of expanding the tubes or the sleeves by large diametrical amounts with no loss in reliability. Further, it would be desirable if the sealing mechanism of this mandrel were capable of effecting a great number of expansions before replacement of the sealing parts became necessary.

SUMMARY OF THE INVENTION

In its broadest sense, the invention is a bladder mandrel which generally comprises a mandrel assembly having a fluid port for conducting a pressurized fluid to its outside surface, and a bladder formed from a thermo-elastomer sleeve which circumscribes the mandrel assembly over the fluid port. In the preferred embodiment, the sleeve is formed from Pellethane® due to the memory and durability that this elastomer has when exposed to high fluid pressures. The mandrel assembly and the Pellethane® sleeve are dimensioned to afford annular clearance between the conduit being expanded and the mandrel assembly, so that the bladder mandrel may easily be slid up the conduit (which may be a heat exchange tube or a reinforcement sleeve) without lubricants.

The edges of the thermo-elastomer sleeve terminate in sealing beads, each of which may include a fluid-capturing recess for capturing pressurized fluid flowing out of the fluid port of the mandrel assembly so that this fluid sealingly engages each of the beads within the mandrel assembly. The mandrel assembly may further include a pair of complementary grooves for receiving the sealing beads of the sleeve forming the bladder.

The invention may further include a means for detachably securing the sealing beads of the bladder sleeve into the grooves of the mandrel assembly in order to facilitate the installation and replacement of the bladder sleeve. This means for detachably securing the sealing beads may include a pair of removable securing rings which serve to secure the sealing beads within their respective grooves in the mandrel assembly. Each of the securing rings may further include an annular groove around its inner surface for receiving the outer portion of the sealing beads when the rings are mounted around the mandrel assembly. To further facilitate the installation and the removal of the bladder sleeve, the mandrel assembly may include a pair of joints located within the bead-receiving grooves.

In order to minimize the outer diameter of the sleeve forming the bladder of the mandrel, and to produce a tube expansion flanked by stress-relieving transition zones, the walls of the sleeve are thinnest at their center portions, and become progressively thicker toward the sealing beads at either end of the sleeve. The use of a Pellethane® sleeve having this particular wall thickness configuration permits the sleeve forming the bladder to be considerably smaller than the inner diameter of the tube (or sleeve) being expanded, and allows the bladder mandrel to be easily inserted and removed from the inside of the tube with essentially no frictional binding between the inner walls of the tube and the sleeve forming the bladder. Additionally, the use of a wall thickness configuration which gradually thickens toward the ends of the mandrel assembly creates transition zones on either side of the expansion which gradually melds the expanded portion of the tube or sleeve into the unexpanded portions, thereby minimizing stresses.

DESCRIPTION OF THE SEVERAL FIGURES

DETAILED DESCRIPTION OF THE PREFERRED EMBODIMENT

Figure 1:
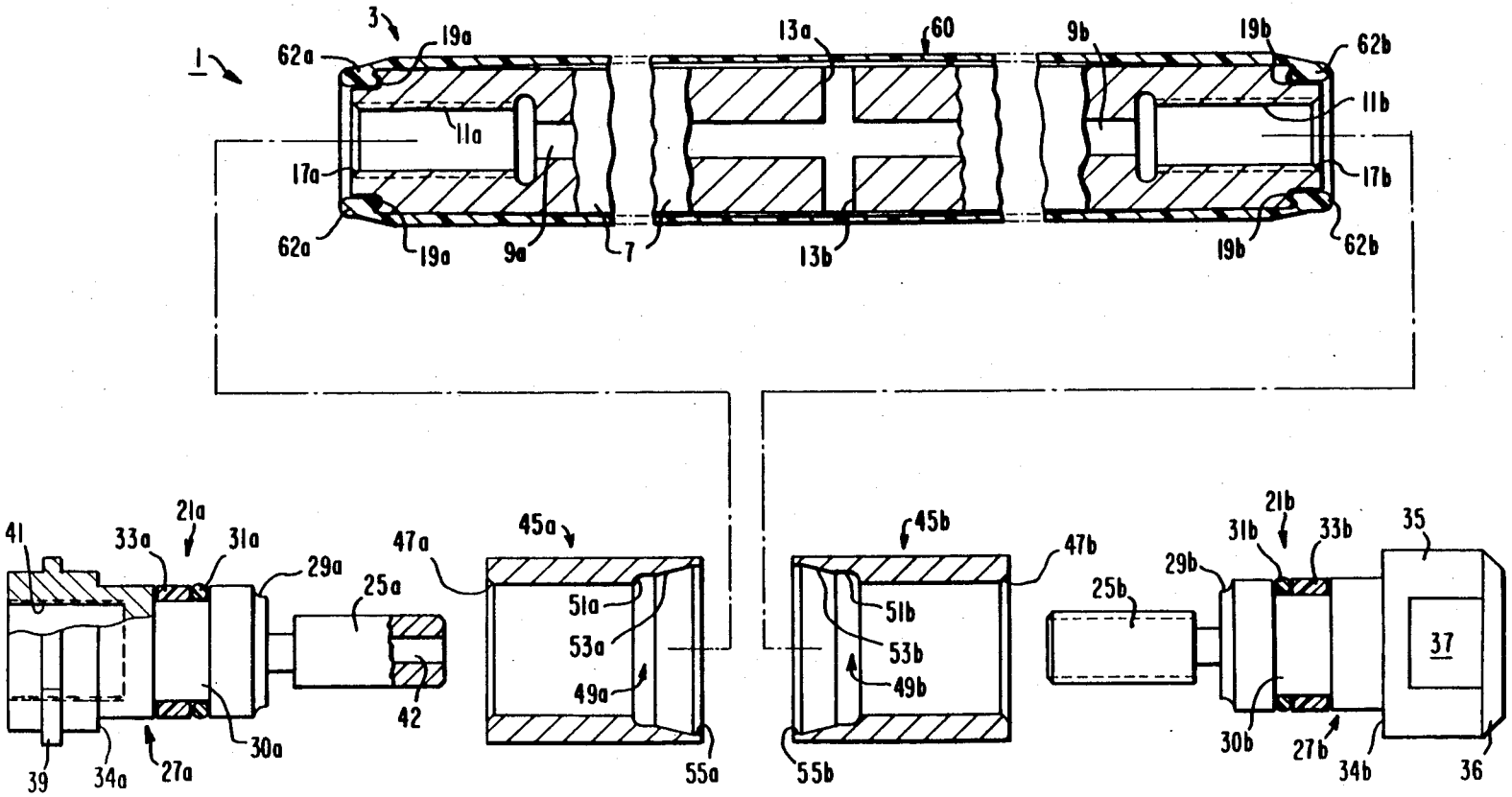
FIG. 1 is an exploded, cross-sectional view of the bladder mandrel of the invention.

With reference now to FIG. 1, wherein like numerals denote like components of the invention throughout all of the several figures, the preferred embodiment of the invention generally comprises a bladder mandrel 1 having a mandrel assembly 3 which is circumscribed by a bladder sleeve 60. As will be discussed in more detail hereinafter, the mandrel assembly 3 includes an elongated, cylindrical mandrel body 7 joined to a pair of mandrel end pieces **21*a*, 21*b*. The mandrel body 7 includes a pair of lateral outlet ports 13*a*, 13*b* for conducting pressurized water from a hydraulic expansion unit (not shown) to the annular space between the outer surface of the mandrel body 7 and the inner surface of the bladder sleeve 60. The edges of the sleeve 60 terminate in a pair of sealing beads 62*a*, 62*b*** which are captured between a pair of annular grooves located at the junction between the mandrel body 7 and the mandrel end pieces 21a, 21b. The hydraulic expansion unit used to pump pressurized water through the lateral ports 13a, 13b may be any one of a number of commercially available devices, such as a Hydroswage(R) brand hydraulic expander manufactured by Haskel, Inc. of Burbank, Calif. Unless specified otherwise, all parts of the mandrel assembly 3 are formed from 17-4 pH stainless steel which is highly corrosion-resistant, yet relatively easy to machine.

Returning now to a more detailed description of the mandrel assembly 3, the elongated, cylindrical mandrel body 7 includes a pair of centrally disposed bores 9a, 9b for conducting pressurized water from the hydraulic expansion unit to the previously mentioned lateral outlet ports 13a, 13b. As indicated in FIG. 1, the inner ends of the bores 9a, 9b meld terminate in the lateral outlet ports 13a, 13b, while the outer ends of these bores expand into enlarged, threaded portions 11a, 11b which may threadably receive the male portions 25a, 25b of the mandrel end pieces 21a, 21b, respectively. In order to facilitate engagement between the enlarged, threaded portions 11a, 11b of the bores 9a, 9b with the aforementioned threaded male portions 25a, 25b, each of the enlarged, threaded portions 11a, 11b terminates in a beveled mouth 17a, 17b. Circumscribing each end of the mandrel body 7 are annular grooves 19a, 19b, each of which has a generally semicircular cross-section. In the preferred embodiment, the cross-sectional shape of the grooves 19a, 19b is complementary to the inner portions of the sealing beads 62a, 62b so that these grooves may receive the sealing beads in the relatively close-fitting configuration best seen in FIG. 3.

Turning now in detail to the mandrel end pieces 21a, 21b, end piece 21a constitutes a mandrel end cap, while end piece 21b is a connector adapter for hydraulically coupling the mandrel assembly 3 to a section of high-pressure hose from the hydraulic expansion unit. Despite their different functions, the end cap 21a and the connector adapter 21b share a number of components which are structurally and functionally identical. At their inner ends, each of these end pieces includes the aforementioned threaded male portion 25a, 25b which is receivable within the enlarged, threaded portions 11a, 11b of the mandrel body 7. At their middle portions, each of these end pieces 21a, 21b includes a ring-retaining section 27a, 27b having an annular recess 30a, 30b which includes both an O-ring 30a, 30b and a urethane sealing ring 33a, 33b. The general function of the ring-retaining sections 27a, 27b is to sealingly retain a pair of securing rings 45a, 45b in order to secure the sealing beads 62a, 62b within their respective complementary grooves 19a, 19b and the mandrel body 7, respectively. At their inner ends, the ring-retaining sections 27a, 27b each include annular bead receiving grooves 29a, 29b at their inner ends. As is best seen with respect to FIG. 3, each of these annular grooves 29a, 29b has an arcuate cross-section which melds with the generally semicircular cross-section of the annuar grooves 19a, 19b located at the ends of the mandrel body 7 when the mandrel end pieces 21a, 21b are threadably connected. Near their outer ends, each of the mandrel end pieces 21a, 21b includes an annular shoulder 34a, 34b which the outer edges of the securing rings 45a, 45b abut when the bladder mandrel is fully assembled.

Turning now to the parts of the mandrel end pieces 21a, 21b which are unique, the end piece 21b forming the end cap of the mandrel assembly 3 includes a cap section 35 which terminates in a bevel portion 36 to facilitate the insertion of the mandrel assembly 3 into the mouth of a sleeve, or a heat exchange tube incident to an expansion operation. Additionally, cap section 35 includes a pair of wrench flats 37 for facilitating the assembly or disassembly of the mandrel assembly 3 with a suitable wrench. As is evident from FIG. 1, the end piece 21b forming the end cap of the mandrel assembly 1 is preferably solidly constructed without bores or hollows. By contrast, the mandrel end piece 21a which forms the connector adapter of the mandrel assembly 3 includes a centrally disposed bore 42 which extends completely through its ring-retaining section 27a and the threaded male portion 25a. This centrally disposed bore 42 expands into enlarged female threaded portion 41 which is mateable with the threaded end of a section of a high-pressure hose (not shown) hydraulically connected to the hydraulic expansion unit. Circumscribing the outside end of the connector adapter forming the mandrel end piece 21a is a nut portion 39 which is integrally formed with the body of the adapter as shown. Like the previously-discussed wrench flats 37 of the end cap, this nut section 39 includes a plurality of parallel, wrench-engaging faces for facilitating the assembly and disassembly of the bladder mandrel 1.

The securing rings 45a, 45b each have a generally cylindrical interior which complements the cylindrical exterior of the ring-retaining sections 27a, 27b of the end pieces 21a, 21b. The outer edges of each of the securing rings 45a, 45b includes a beveled edge 47a, 47b for assisting the operator in sliding the outer ends of these rings over the ring-retaining sections 27a, 27b of the mandrel end pieces 21a, 21b when the bladder mandrel 1 is assembled. The inner diameter of the rings 45a, 45b and the outer diameter of both the O-rings and urethane rings 31a, 33a and 31b, 33b are dimensioned so that these O-rings and urethane rings form a water-tight seal around the inner surface of the securing rings 45a, 45b when the outer ends of these rings are slid up against the shoulders 34a, 34b of the end pieces 21a, 21b, respectively. At its inner end, each of the securing rings 45a, 45b includes a bead-securing portion 49a, 49b for securing the outer portion of the sealing beads 62a, 62b of the bladder sleeve 60. More specifically, each of the bead-securing portions 49a, 49b includes an annular bead-securing groove 51a, 51b and a frustro-conical ramp 53a, 53b. The arcuate cross-section of each of the bead-securing grooves 51a, 51b is complementary to the shape of the outer portion of the sealing beads 62a, 62b. Additionally, each of the frustro-conical ramps 53a, 53b terminates in the outer edge of its respective bead-securing groove 51a, 51b. These ramps help to wedge the outer portions of the sealing beads 62a, 62b into the bead-receiving grooves 51a, 51b when the mouths 55a, 55b of the securing rings 45a, 45b are compressed against the ends of the mandrel body 7, as occurs when the threaded male portions 25a, 25b of the mandrel end pieces 21a, 21b are screwed into the enlarged threaded portions 11a, 11b of the mandrel body 7.

Figure 2:
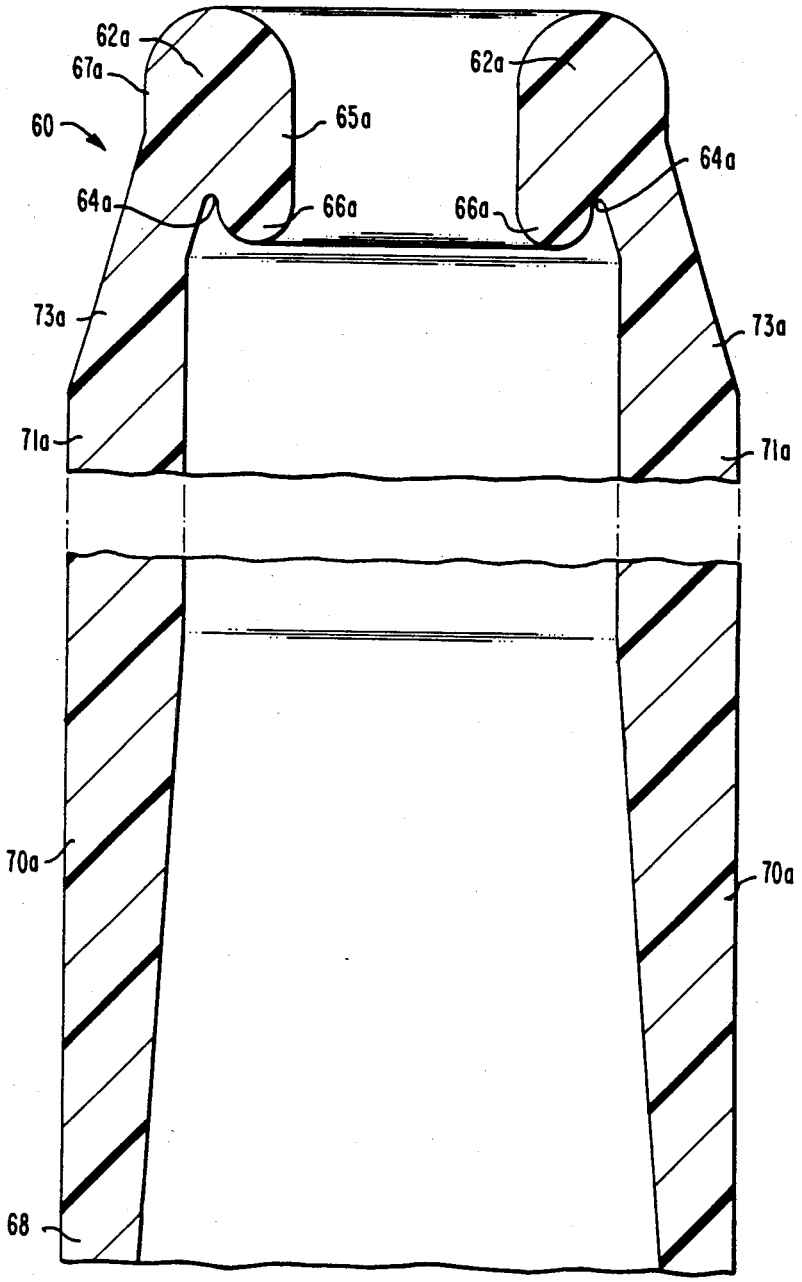
FIG. 2 is a cross-sectional view of the sleeve which forms the bladder of the mandrel.

Turning now to FIG. 2, the sleeve 60 is preferably integrally formed from a durable, thermoelastomer material having a memory. In the preferred embodiment, the sleeve 60 is formed from Pellethane® CPR-2103-55D. The applicant has found that the use of this material allows the walls of the sleeve 60 to be made sufficiently thin enough so that a substantial amount of annular clearance may exist between the outer diameter of the sleeve 60 circumscribing the mandrel assembly 3 and the inner diameter of the reinforcing sleeve or the heat exchange tube being expanded. This annular clearance in turn allows the mandrel assembly 3 to be easily inserted into the mouth of either a tube or a sleeve, and slid to a desired position along the longitudinal axis of the sleeve or the tube without binding and without the need for lubricants such as glycerine. Additionally, the applicant has found that a sleeve formed from Pellethane® can withstand hydraulic pressures of over 22,000 psi without leaking, which in turn allows it to produce diametrical expansions of over 0.20 in. Finally, the use of Pellethane® in the sleeve 60 affords a sleeve which may be used for over two hundred expansion operations before replacement is necessary. While the applicant has found that Estane® polyurethane compound No. 58810 (available from B.F. Goodrich located in Cleveland, Ohio) may also be used to form the bladder sleeve 60, Pellethane® is the generally preferred material.

The structure of the sleeve 60 is perfectly symmetrical about its longitudinal axis. Accordingly, only the upper half of the sleeve 60 is illustrated in FIG. 2, it being understood that both the walls and the sealing bead **62*b* of the lower half is structurally identical in all respects. The walls of the sleeve 60 include a centrally disposed thin portion 68, a tapered portion 70*a*, 70*b* located on either side of the thin portion 68, and relatively thick portions 71*a*, 71*b* which integrally connect the tapered portions 70 with the edge portions 73*a*, 73*b*, which terminate in the sealing beads 62*a*, 62*b*. The centrally disposed thin portion 68 of the sleeve walls extends the length of the desired central expansion zone of the bladder mandrel 1, while the tapered sections 70*a*, 70*b* are approximately the desired length of the transition zones flanking the control tube expansion. Generally, the wall thickness of the sleeve 60 increases by approximately 50% from the center of the thin-walled portion 68 to the edge portions 73*a*, 73*b* of the sleeve 60 in order to produce the desired pattern of a central expansion zone flanked by transition zones. As will be discussed in detail hereinafter, the provision of such transition zones in the tube expansion is important because they minimize the amount of residual stress the expansion generates in the tube or sleeve. Sealing beads 62*a*, 62*b* each include a fluid-capturing recess 64*a* located between the upper edge of the inner wall of the sleeve 60 and the inner portion 65*a* of the bead. The provision of such fluid-capturing recesses 64*a*, 64*b* form generally semicircular protuberances 66*a*, 66*b* in the inner portions of each of the sealing beads 62*a*, 62*b* as illustrated. These protuberances 66*a*, 66*b* are receivable within the grooves 19*a*, 19*b* and located at the ends of the mandrel body 7 and the mandrel end pieces 21*a*, 21*b*, respectively. It should be noted that each of the sealing beads 62*a*, 62*b* further includes outer portions 67*a*, 67*b* which are receivable within the grooves 51*a*, 51*b* of the securing rings 45*a*, 45*b*** in a manner which will be described presently.

Figure 3:
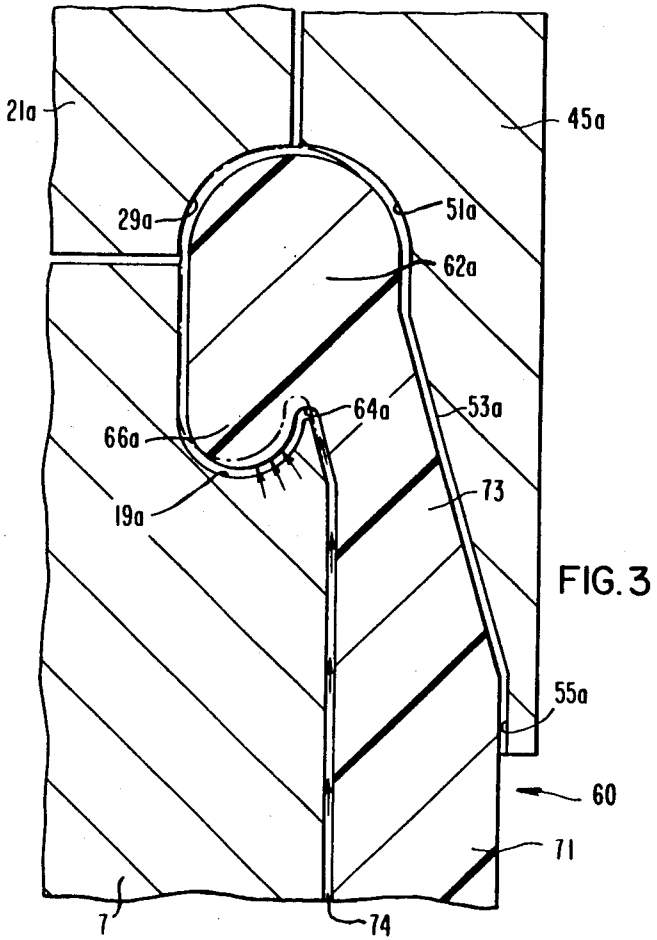
FIG. 3 is an enlarged, cross-sectional view of one of the sealing beads of the sleeve and the portions of the mandrel body, the mandrel end piece, and the securing ring which surrounds and captures this sealing bead.

FIG. 3 illustrates the manner in which the sealing beads **62*a*, 62*b* are captured within the grooves 19*a*, 19*b*, 29*a*, 29*b* and 51*a*, 51*b* of the mandrel body 7, the end pieces 21*a*, 21*b* and the securing rings 45*a*, 45*b*, respectively. Since the bead-capturing mechanism is identical for both sealing beads 62*a* and 62*b*, this mechanism will be discussed in detail only with respect to sealing bead 62*a*, it being understood that the bead-capturing mechanism formed by the grooves 19*a*, 29*b* and 51*b* coacts with sealing bead 62*b* in an identical manner. As is evident from FIG. 3, the grooves 19*a*, 29*a* and 51*a* come together to form a single bead-capturing groove which is substantially complementary in shape to the profile of the sealing bead 62*a*. When the bladder mandrel 1 is in an unexpanded state, with no pressurized water flowing between the sleeve 60 and the mandrel body 7, the outside surface of the sealing bead 62*a* is not sealingly engaged against any of the grooves 19*a*, 29*a* and 51*a*, but is merely held captive in the space defined by these grooves. However, as pressurized water enters the annular space 74 defined between the inner surface of the sleeve 60 and the outer surface of the mandrel body 7, it flows into the fluid-capturing groove 64*a* of the sealing bead 62*a*, and begins to apply a force against the protuberance 66*a* of the bead 62*a* as indicated by the arrows in FIG. 3. This force ultimately causes the protuberance 66*a* to "swing out" and engage itself against the generally semi-circular groove 19*a* of the mandrel body 7 in a water-tight seal. Ultimately, the pressure that the water flowing through the annular space 74 exerts on the fluid-capturing recess 64*a* deforms the inner portion 65*a* of the resilient sealing bead 62*a* so that it sealingly engages the grooves 19*a* and 29*a* of the mandrel body and the mandrel end piece 7 and 21*a*, while the outer portion 67*a* of the bead 62*a* sealingly engages the arcuate groove 51*a* of the sealing ring 45*a*, as indicated in phantom in FIG. 3. When this pressure is released, the sealing bead 62*a* reassumes its initial non-engaging position within the grooves 19*a*, 29*a* and 51*a*. It should be noted that the provision of a resilient sealing bead 62*a* having a fluid-capturing recess 64*a* which causes the bead 62*a* to form a pressure-tight seal whenever pressurized water flows into the recess 64*a* greatly simplifies the seal structure of the invention; the sealing force is generated by the pressurized water flowing out of the mandrel, and not by a complicated array of screw fittings, resilient washers and gaskets. This structure also protracts the life of the sealing beads 62*a*, 62*b*, since virtually no stresses or pressures are applied to them in the time between expansion operations. Finally, the provision of a bead-capturing mechanism which may be quickly disassembled by unscrewing the mandrel end pieces 21*a*, 21*b* from the mandrel body 7 and removing the securing rings 45*a*, 45*b* from the end pieces 21*a*, 21*b* greatly facilitates the installation and removal of the mandrel sleeve 60**.

Figure 4A:
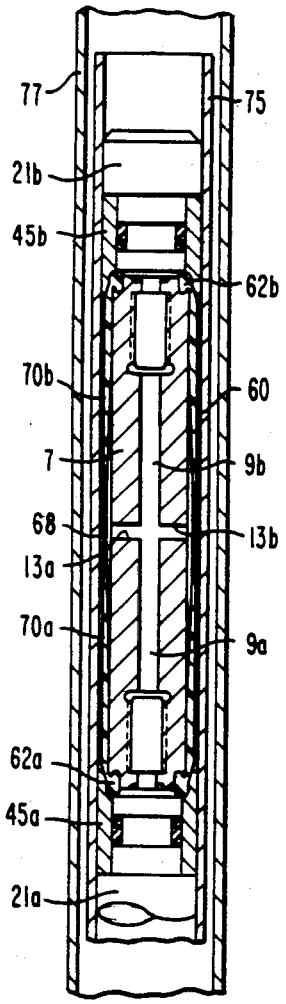
FIG. 4A and 4B are cross-sectional side views of a bladder mandrel of the invention disposed within a reinforcing sleeve which is positioned across a corroded section of a heat exchange tube, demonstrating how the bladder sleeve creates an interference-type joint between the sleeve and the tube.
Figure 4B:
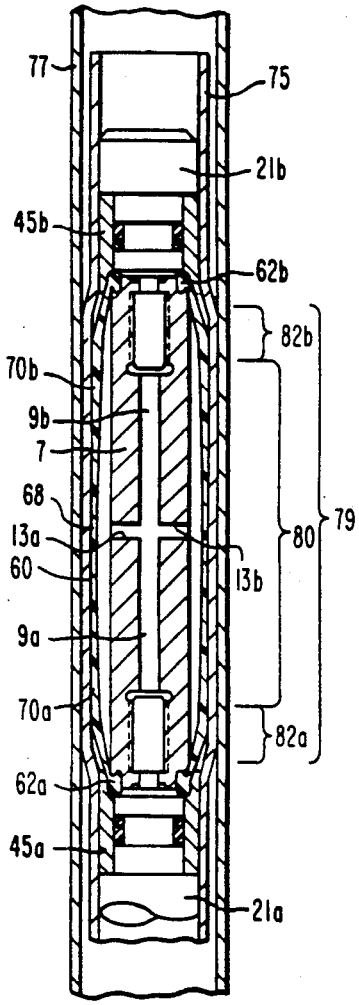

FIGS. 4A and 4B illustrate how the bladder mandrel may be used to form an interference-type joint between a reinforcing sleeve 75 and a section of a heat exchange tube 77 in a steam generator. More specifically. FIG. 4A illustrates the bladder mandrel 1 in proper position to effect such a joint between the sleeve 75 and the heat exchange tube 77 before the hydraulic expansion unit (not shown) generates a flow of high-pressure water out of the lateral ports **13*a*, 13*b* of the mandrel body 7. Preferably, once the sleeve 75 is properly positioned along the longitudinal axis of the tube 77, the bladder sleeve 60 of the mandrel 1 is disposed toward the upper end of the sleeve 75 as shown, with an appropriate amount of longitudinal distance between the upper edge of the sleeve 60 and the upper edge of the sleeve 75. FIG. 4B illustrates the manner in which the sleeve 60 of the bladder mandrel 1 radially expands the reinforcing sleeve 75 into the tube 77 after the hydraulic expansion unit is actuated. Due to its thinner wall section, the central portion 60 of the sleeve transmits the greatest amount of radially expansive force as the hydraulic expansion unit fills the annular space between the inside of the bladder sleeve 60 and the outer surface of the mandrel body 7 with pressurized water. Conversely, because of their relatively thicker portions, the tapered wall sections 70a, 70b of the sleeve 60 transmit less and less radially-expansive force to the sleeve 75 and the tube 77, the closer one comes to the sealing beads 62a, 62b. Finally, the sections of the sleeve 60 closest to the sealing beads 62a, 62b transmit virtually no radially-expansive force to the sleeve 75 and the tube 77 due to the tensile forces that these regions of the sleeve 60 exert against the pressurized water flowing between the inside walls of the sleeve 60 and the outside surface of the mandrel body 7. The end result is that the expansion zone 79 produced by the bladder sleeve 60 includes a cylindrically shaped central zone 80 which is approximately the same length as the thin-walled central portion 68, which is flanked by frustro-conical transition zones 82a, 82b which correspond to the tapered wall sections 70a, 70b of the sleeve 60, respectively. In the preferred embodiment, the tapered wall sections 70a, 70b** are dimensioned so that the transition zones which they produce are about 0.250 in. in length.

Figure 5:
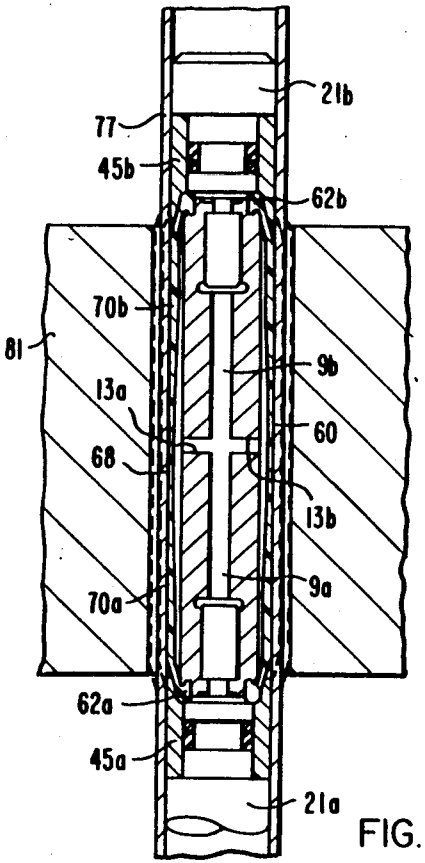
FIG. 5 is a cross-sectional side view of the bladder mandrel of the invention disposed within a section of a heat exchange tube which extends through a support plate in a steam generator.

FIG. 5 illustrates how the bladder mandrel 1 of the invention may be used to expand a heat exchange tube 77 in the vicinity of a support plate 81. In such expansions, the bladder sleeve 60 is symmetrically disposed about the edges of the support plate 81. Additionally, the centrally disposed thin wall section 68 of the bladder sleeve 60 is dimensioned along its longitudinal axis so that it does not extend over either edge of the support plate when the bladder mandrel 1 is central positioned about the center line of the plate 81. When pressurized water from the hydraulic expansion unit flows out of the lateral ports 13a, 13b and in the annular space between the outside of the mandrel body 7 and the inside surface of the bladder sleeve 60. the sleeve 60 expands in the same manner as heretofore described with respect to the sleeving operation, i.e., with the thin-walled section 68 applying the most radially expansive force to the walls of the tube 77 and the tapered thick-walled sections 70a, 70b applying correspondingly less radially expansive force the closer these wall sections come to their respective sealing beads 62a, 62b. As indicated in phantom in FIG. 5, the resulting expansion is a centrally-disposed cylindrical center portion flanked by two frustro-conical transition zones which meld the expanded portion of the tube 77 with the unexpanded portions of the tube 77 on either side thereof.

Figure 6A:
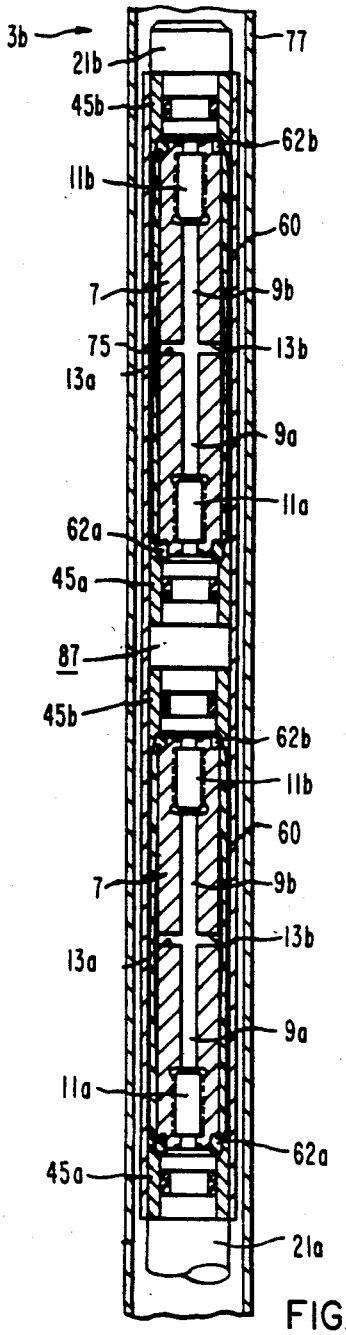
FIG. 6A is a cross-sectional side view of an alternate embodiment of the bladder mandrel of the invention which includes two mandrel bodies, each of which is circumscribed by a bladder sleeve.
Figure 6B:
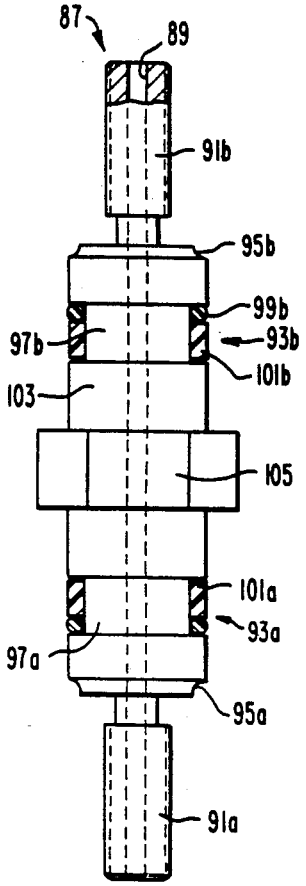
FIG. 6B is a partial, cross-sectional side view of a center extension member which may be used to construct the double bladder mandrel illustrated in FIG. 6A.

FIG. 6A illustrates an alternative embodiment of the invention which employs two bladder mandrels 1, while FIG. 6B illustrates an extension member 87 which allows the construction of the double-mandrel assembly 85 shown in FIG. 6A.

With specific reference now to FIG. 6B, the center extension member 87 is a substantially cylindrical member having a centrally disposed bore 89 for conducting pressurized fluid from the centrally disposed bores 9a, 9b of mandrel assembly 3a up through the centralized bores 9a, 9b of the mandrel assembly 3b of the double bladder assembly 85. At either end of the center extension member 87 is a threaded male portion 91a, 91b. These threaded male portions are threadably engageable into the upper enlarged threaded portion 11b of the mandrel body 7 of the mandrel assembly 3a. Analogously, threaded male portion 91a is threadably engageable into the enlarged threaded portion 11a of the mandrel body 7 of the mandrel assembly 3b. Like the previously discussed mandrel end pieces 21a, 21b, the center extension member 87 next includes a pair of ring retaining sections 93a, 93b arranged back to back, as shown. The inner edges of each of the ring-retaining sections 93a, 93b include annular grooves 95a, 95b, each of which includes an arcuate cross-section. Each of the grooves 95a, 95b is analogous in function to the previously discussed grooves 29a, 29b of the mandrel end pieces 21a, 21b. More specifically, these grooves 95a, 95b meld in with the annular grooves located in the upper and lower ends of the mandrel bodies of the mandrel assemblies 3a, 3b to form a groove which is complementary in shape to the inner portion of the sealing beads 62a, 62b *of these mandrel assemblies 3a, 3b*. Each of the ring-retaining sections 93a, 93b further includes an annular recess 97a, 97b which is circumscribed by both an O-ring 99a, 99b and a urethane ring 101a, 101b, respectively. These O-rings and urethane rings sealingly engage the securing rings 45b and 45a of the mandrel assemblies 3a, 3b when the center extension member 87 is connected with the mandrel assemblies 3a, 3b in the configuration illustrated in FIG. 6A. Finally, the center extension member 87 includes a center section 103 which may be of any desired length. Center section 103 preferably includes a pair of wrench flats 105 for facilitating the assembly and disassembly of the double-mandrel embodiment illustrated in FIG. 6A. The double-mandrel assembly 85 is particularly useful in generating an interference-type joint between a sleeve 75 and a heat exchange tube 77 because it allows both ends of the sleeve 75 to be joined within a heat exchange tube 77 in a single expansion step.

What is claimed is:

1. A bladder mandrel for applying a radially expansive pressure of at least 3500 psi to the interior of a conduit in order to permanently expand said conduit, comprising:

(a) a mandrel assembly having a fluid port for conducting pressurized fluid to the outside surface of the mandrel assembly;

(b) a pressurized fluid source fluidly connected to the port of the mandrel assembly, and (c) a bladder formed from a sleeve of Pellethane® CPR® 2103-55D which circumscribes the mandrel assembly over the fluid port.

2. A bladder mandrel as defined in claim 1, wherein the edges of the sleeve terminate in sealing beads.

3. A bladder mandrel as defined in claim 2, further including means for detachably securing the sealing beads of the sleeve which include a pair of grooves circumscribing the mandrel assembly for receiving the sealing beads.

4. A bladder mandrel as defined in claim 3, wherein the grooves circumscribing the mandrel assembly are complementary in shape to the sealing beads.

5. A bladder mandrel as defined in claim 4, wherein said means for detachably securing the sealing beads further includes a pair of removable securing rings for securing the sealing beads within their respective complementary grooves in the mandrel assembly.

6. A bladder mandrel as defined in claim 5, wherein each of the securing rings includes an annular groove on its inner surface for receiving the outer portion of its respective sealing bead.

7. A bladder mandrel as defined in claim 6, wherein each of the grooves circumscribing the inner surfaces of the securing rings is complementary in shape to the outer portion of its respective sealing bead.

8. A bladder mandrel as defined in claim 7, wherein said means for detachably securing said sealing beads further includes a pair of joints in the mandrel assembly for allowing the mandrel assembly to be disassembled at points across the bead receiving grooves in the mandrel assembly in order to facilitate the installation and removal of the sleeve around the mandrel assembly.

9. A bladder mandrel for applying a radially expansive pressure of at least 3,500 psi to the interior of a conduit in order to permanently expand said conduit, comprising:

(a) a mandrel assembly including a mandrel body and first and second mandrel end pieces detachably joinable to the ends of the mandrel body, wherein said mandrel body includes a fluid port for conducting pressurized fluid to the outside surface of the mandrel body;

(b) a pressurized fluid source fluidly connected to the port of the mandrel body, and (c) a blader formed from a resilient sleeve of thermoelastomer material circumscribing the mandrel assembly over the fluid port, wherein the edges of the sleeve terminate in sealing beads which are detachably interlockable within first and second grooves which circumscribe the joints between the mandrel body and the first and second mandrel end pieces, whereby the installation and removal of the resilient sleeve may be facilitated by the removal of the detachably joinable mandrel end pieces from the mandrel body.

10. A bladder mandrel as defined in claim 9, further including a pair of removable securing rings for securing each of the sealing beads within its respective groove in the mandrel assembly, wherein the inner surfaces of the rings circumscribe the outer portions of the sealing beads of the sleeve.

11. A bladder mandrel as defined in claim 10, wherein the inner surface of each of the removable securing rings includes a groove for receiving the outer portion of its respective sealing bead.

12. A bladder mandrel as defined in claim 11, wherein each of the grooves circumscribing the inner walls of the rings is complementary in shape to the outer portion of its respective sealing bead.

13. A bladder mandrel as defined in claim 9, wherein the bladder is formed from a resilient sleeve of polyurethane.

14. A bladder mandrel as defined in claim 9, wherein the bladder is formed from a resilient sleeve of Pellethane® CPR® 2103-55D.

15. A bladder mandrel as defined in claim 9, wherein the walls of the sleeve become progressively from the center portion of the sleeve to the beads along its edges.

16. A bladder mandrel as defined in claim 9, wherein said first mandrel end piece is an end cap, and said second mandrel end piece is an extension member.

17. A bladder mandrel as defined in claim 9, wherein said first mandrel end piece is an end cap, and said second mandrel end piece is a connector adapter.

18. A bladder mandrel for applying a radially expansive pressure of at least 3,500 psi to the interior of a conduit in order to permanently expand said conduit, comprising:

(a) a mandrel assembly having a fluid port for conducting fluid to the outside surface of the mandrel assembly;

(b) a pressurized fluid source fluidly connected to the port of the mandrel, and (c) a bladder formed from a sleeve of Pellethane® CPR® 2103-55D circumscribing the mandrel assembly over the fluid port, wherein each of the edges of the sleeve terminates in a rounded sealing bead.

19. A bladder mandrel as defined in claim 18, wherein the mandrel assembly includes a pair of annular grooves for interlockably receiving the rounded sealing beads of the sleeve, and wherein said annular grooves are each formed in part by a pair of detachably removable securing rings.

20. A bladder mandrel as defined in claim 19, wherein each of the securing rings includes an annular groove in its inner wall which is complementary in shape to the outer portion of its respective sealing bead for receiving the outer portion of the sealing bead when the securing ring is mounted onto the mandrel assembly.

21. A bladder mandrel as defined in claim 20, wherein the walls of the sleeve become progressively thicker from the center portion of the sleeve to the beads along its edges.

22. A bladder mandrel as defined in claim 20, wherein the mandrel assembly is formed from a mandrel body having a fluid port, and detachably joinable mandrel end pieces which are detachably joinable onto each end of the mandrel body, and wherein each joint defined by the mandrel end pieces is positioned within one of said bead receiving grooves, whereby the sleeve may be easily removed or installed by detaching the mandrel end pieces from the mandrel body.

23. A bladder mandrel for applying a radially expansive pressure of at least 3500 psi to the interior of a tube in order to permanently expand said tube, comprising:

(a) a mandrel assembly including an elongated mandrel body having a mandrel end piece detachably joined to each of its ends, wherein the mandrel body includes a fluid port for conducting pressurized fluid to its outside surface, and wherein each joint between the mandrel body and the mandrel end pieces includes an annular groove which circumscribes the joint;

(b) a pressurized fluid source fluidly connected to the port of the mandrel body, and (c) a bladder formed from a resilient sleeve of Pellethane® CPR® 2103-55D circumscribing the mandrel body over the fluid port, wherein the edges of the sleeve terminate in rounded sealing beads interlockably receivable in the grooves circumscribing the joints between the mandrel body and the mandrel end pieces, wherein the joints between the mandrel body and the mandrel end pieces facilitate the installation and removal of the sleeve by releasing the beads from the grooves circumscribing these joints when the mandrel end pieces are disjoined from the mandrel body.

24. A bladder mandrel as defined in claim 23, further including a pair of removable securing rings for further defining the annular grooves that secure the sealing beads of the sleeve in the mandrel assembly.

* * * * *